US005232159A

United States Patent [19]

Abbate, Sr. et al.

[11] Patent Number: 5,232,159

[45] Date of Patent: Aug. 3, 1993

[54] SPRINKLER AND EDGING APPARATUS

[75] Inventors: Joseph P. Abbate, Sr., Barrington; Denis Abbate, Barrington Hills; Marshall Shapiro, Schaumburg, all of Ill.

[73] Assignee: Abbat Products International, Inc., Bensenville, Ill.

[21] Appl. No.: 729,929

[22] Filed: Jul. 15, 1991

[51] Int. Cl.[5] ..... B05B 15/06

[52] U.S. Cl. ..... 239/276; 239/547

[58] Field of Search ..... 239/201, 273, 276, 542, 239/547; 285/242, 243, 253; 248/544

[56] References Cited

U.S. PATENT DOCUMENTS

| | | | |
|---|---|---|---|
| 1,785,314 | 12/1930 | Kelly | 285/253 |
| 2,208,706 | 7/1940 | Spencer | 285/253 |
| 3,387,786 | 6/1968 | Rynberk | 239/276 |
| 3,485,449 | 12/1969 | Wilson | 239/201 |
| 3,759,445 | 9/1973 | King | 239/201 |
| 4,702,034 | 10/1987 | Ferguson et al. | 239/276 |

FOREIGN PATENT DOCUMENTS

| | | | |
|---|---|---|---|
| 2165614 | 4/1986 | United Kingdom | 239/276 |

*Primary Examiner*—Andres Kashnikow
*Assistant Examiner*—Karen B. Merritt
*Attorney, Agent, or Firm*—Welsh & Katz, Ltd.

[57] ABSTRACT

A sprinkler and edging apparatus includes an extruded plastic section having a tubular portion and a depending web portion with a flange, the tubular portion having a pattern of slits on a front side thereof to create a mist for watering landscape plants when water is passed through the tubular portion. The web portion is provided with notches at each end which accommodate clamps for connecting adjacent sections together, for connecting the water supply hose thereto, and/or for plugging a free end of the section against water leakage.

23 Claims, 1 Drawing Sheet

SPRINKLER AND EDGING APPARATUS

BACKGROUND OF THE INVENTION

The present invention relates generally to landscape edging devices for defining boundaries of lawns and/or planting beds, and more specifically to an edging apparatus having the capability of watering desired plants.

Landscape edging is provided in many forms, including brick, concrete, stone, metal, treated wood, and plastic. Of these, plastic edging has significant advantages, in that it is relatively inexpensive and easy to manipulate during installation. Also, plastic edging does not rot or rust, and requires little if any maintenance.

U.S. Pat. No. 3,387,786 to Rynberk discloses plastic edging in which an upper tubular portion of the edging is used as a water conduit to which a conventional garden hose may be connected. The user must puncture holes into the conduit at locations where it is desired to water specific plants.

A significant disadvantage of such a system relates to the fact that the plastic material used to manufacture the edging must be sufficiently thick for structural and durability considerations. As such, the act of puncturing the cylindrical tubular portion is difficult, and potentially dangerous if performed with a dull tool or improvised utensil, of the type often used by recreational gardeners. When several plants are present, multiple holes are required, entailing a substantial amount of labor and time in positioning and creating the holes.

Furthermore, the size and position of the hole or holes must be accurate to ensure that the right amount of water reaches the plant at a specific location for optimum results, and maintains proper pressure in the conduits for plants farther from the source of water. Also, in cases where plants are moved from year to year, the location of a specific watering aperture may no longer be appropriate, decreasing the utility of the edging.

Another disadvantage of conventional plastic edging adapted for sprinkling is that it is difficult to install evenly in the ground, and results in an unsightly, nonuniform landscape border. Installation is accomplished by digging an elongate trench of approximately 4–6 inches in depth, inserting a depending web portion of the edging into the trench, and refilling the trench to retain the web in place. A common problem is the inability to dig a trench of sufficient or uniform depth, which causes the edging to appear uneven in the ground. This problem is especially evident when long segments of edging are required, necessitating bulky and often unsightly coupling arrangements. The point of coupling in many cases further detracts from the aesthetic appearance of the edging.

Thus, there is a need for a sprinkler and edging apparatus which provides prepunctured watering apertures capable of watering multiple plants without requiring extensive labor in positioning and puncturing the tubular portion of the edging. There is also a need for such edging which is constructed so that when adjacent sections of edging must be coupled to form long segments, the coupling apparatus is aesthetically pleasing and does not disrupt the overall uniform appearance of the edging.

SUMMARY OF THE INVENTION

Accordingly, a sprinkler and edging apparatus includes an extruded plastic section having a tubular portion and a depending web portion with a flange. The tubular portion has a pattern of slits only on a front side thereof to create a mist for watering landscape plants when water is passed through the tubular portion. On each section, the web portion is provided with notches at each end which accommodate clamps for connecting adjacent sections together, for connecting the water supply hose thereto, and/or for plugging a free end of the section against water leakage.

More specifically, the slits are preferably provided in at least two spaced, parallel rows, with slits in adjacent rows being staggered relative to each other. The shape of the slits and their positioning on the tubular portion of the edging combines to create a misting effect when water is passed through the tubular portion under pressure. In addition, the notches in the web portions are configured to accommodate the length of a clamp, so that when adjacent edge sections are joined, the clamps are basically recessed in the notches, allowing for substantially flush, abutting relationship of the joined sections.

DESCRIPTION OF THE PREFERRED EMBODIMENT

Figure 1:
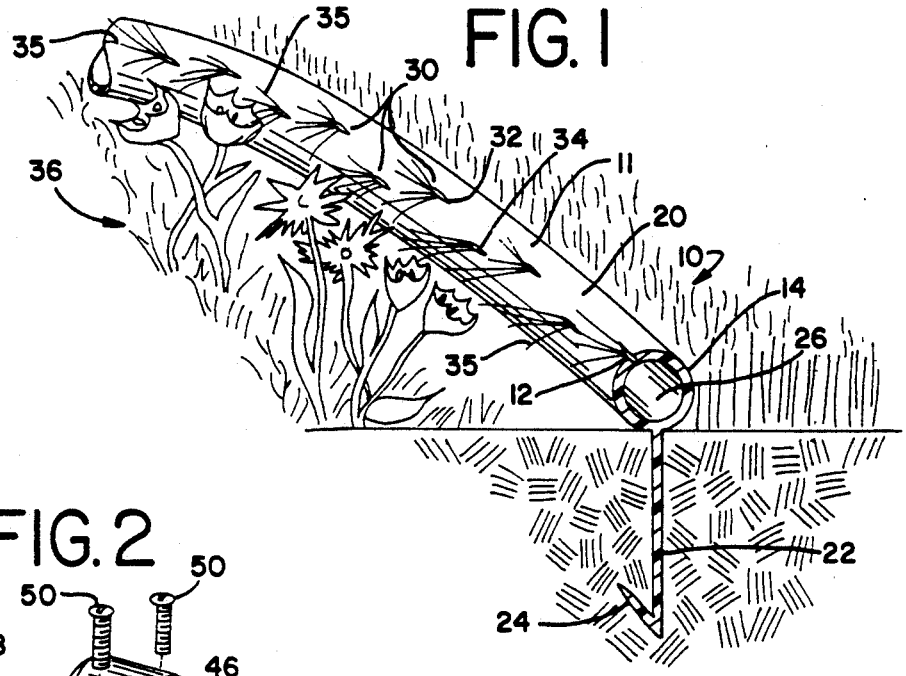
FIG. 1 is a top perspective view in partial section of the sprinkler and edging apparatus of the invention shown installed in a landscape application.

Referring now to FIGS. 1–4, the sprinkler and edging apparatus of the invention is generally indicated at 10. The apparatus 10 is preferably manufactured as an extrusion of a durable plastic material such as polyethylene, polyvinyl chloride, or other suitable material. In the preferred embodiment, the apparatus 10 is provided in elongate sections 11 having a specified length, such as 15 feet. However, other lengths are contemplated.

The apparatus 10 includes opposing front and rear sides 12 and 14 respectively, a first end 16 and an opposing second end 18. In addition, the apparatus 10 includes an upper tubular portion 20 and a vertically depending web portion 22, the web portion being integrally joined to the tubular portion.

A lower edge of the web portion 22 has an upwardly projecting retaining flange 24 secured thereto and preferably extending the entire length of the apparatus 10. Although the flange 24 is shown projecting from the front side 12, it may alternatively project from the rear side 14. The flange 24 forms a pocket against the web portion 22 and, during installation is filled with soil, mulch, rock, etc. to prevent the removal of the apparatus 10 from the ground.

The tubular portion 20 defines an interior passage 26 having an approximate inner diameter of $\frac{5}{8}$ to $\frac{3}{4}$ inches, through which water may be passed upon the connection of a water supply hose 28 (best seen in FIG. 4) to one of the ends 16, 18 of the apparatus 10. A plurality of slits 30 are formed in the tubular portion 20 preferably in only one of the sides 12, 14. In the preferred embodiment, the slits 30 are provided in the front side 12 in two spaced parallel rows, 32, 34, although additional rows or a single row of slits are contemplated.

The slits 30 in the adjacent rows 32, 34 are positioned in a staggered arrangement, so that each slit in row 32 is located approximately equidistantly from each of the nearest slits in the adjacent row 34. Each slit 30 is basically a linear cut of approximately ⅛ to ⅜ inch into the tubular portion 20. The configuration and arrangement of the slits 30 on the front side 12 is designed so that, upon the introduction of water under pressure into the passage 26, water will be emitted in a plurality of jets 35, which both project toward the target plants 36 (best seen in FIG. 1) and intersect each other to form a mist.

The web portion 22 is basically a flat panel having a preferred height of approximately 2½ to 3 inches. At each end 16, 18, the web portion 22 is provided with a notch 38. Each notch 38 is located at an upper end 40 of the web portion 22. The notches 38 are dimensioned to accommodate a lower portion 42 of a clamp 44, which is depicted as a two part hose clamp. In the preferred embodiment, each notch 38 has a height of approximately ½ inch and a length of approximately 1 inch, although the dimensions may vary as to the size and type of clamp 44 which is utilized.

Figure 2:
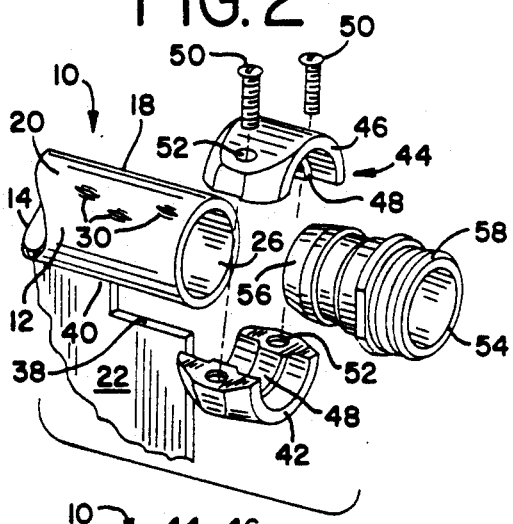
FIG. 2 is a fragmentary perspective exploded view of the present sprinkler and edging apparatus including a clamp and tubular connecting nipple.
Figure 3:
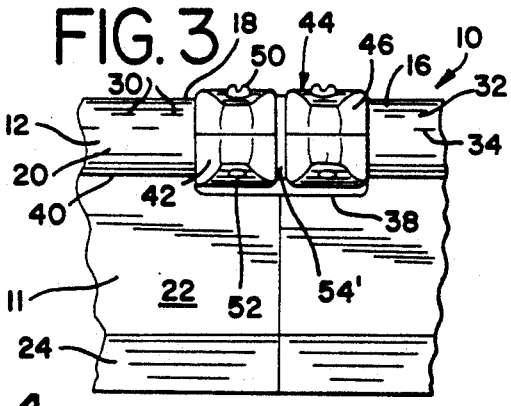
FIG. 3 is a fragmentary front elevational view depicting two adjacent sections of the sprinkler and edging apparatus of FIG. 1 joined together with a pair of clamps.

Referring now to FIGS. 2 and 3, the clamp 44 includes an upper portion 46 which meets the lower portion 42 along a horizontal plane. The upper and lower portions 42, 46, have an arcuate shape, so that when they meet along the horizontal plane, a cylinder is defined, having an approximate diameter of 1 inch. If desired, the clamp portions 42, 46 may also each have a raised inner rib 48 which exerts additional clamping force on a tubular member clamped therein. A pair of releasable fasteners 50, such as sheet metal screws, engage respective bores 52 to secure the clamp portions 42, 46 together along the horizontal axis.

Figure 4:
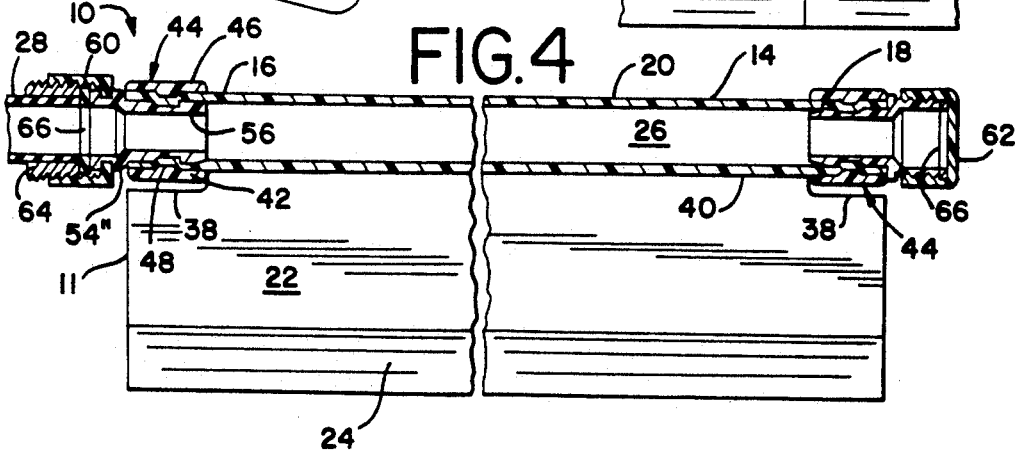
FIG. 4 is a fragmentary vertical sectional view of the present sprinkler shown connected to a water supply hose on the left side, and being plugged on the right side.

A tubular nipple 54 is used to connect each section 11 of the apparatus 10 to specified items, including the water supply hose 28, other like sections, and/or end plugs for preventing water from leaking out the end 16, 18 of the apparatus 10 not connected to the hose 28. Although the nipple 54 is shown in FIG. 2 as having a barbed end 56 and an exteriorly threaded or male end 58, depending on the application, nipples having two barbed ends 56, such as depicted at 54' in FIG. 3, or a barbed end 56 and an interiorly threaded or female end 60, shown at 54" on the left side of FIG. 4, are also contemplated. The barbed end 56 is inserted into the open tubular portion 20 at either end 16, 18, is dimensioned to have a tight friction fit and to slightly expand the tubular portion. The upper and lower portions 46, 42 of the clamp 44 are then assembled around the tubular portion 20 and fastened together using the fasteners 50.

Referring now to FIG. 3, it is evident that when adjacent sections 11 of the apparatus 10 are connected to each other to create longer segments of edging, the clamps 44 are recessed in the respective notches 38 and the tubular portions 20 are in registry with each other to promote the flow of water through the passage 26. Also, to improve the aesthetic appearance of the present apparatus 10 over conventional edging systems, when adjacent sections 11 are joined to each other, as shown in FIG. 3, the sections are in substantially flush abutting relationship, at the tubular portions 20, as well as along opposing edges of the web portions 22. This abutting relationship is due in large part to the dimensions of the notches 38, which allow the clamps 44 to be recessed into the respective ends 16, 18.

Referring now to FIG. 4, a section 11 of the apparatus 10 is shown with a water supply hose 28 connected at the first end 16, and a plug cap 62 shown connected to the second end 18. As discussed previously, the first end 16 is provided with a nipple 54" having a barbed end 56 and a female end 60, into which is threadably engaged the male threaded end 64 of the hose 28. As is known in the art, a conventional hose washer 66 is preferably used to seal this junction. At the end 18, the cap 62 has an internal thread to engage the threaded end 58 of the nipple 54, and is also preferably provided with a washer 66.

In operation, the section 11 of the sprinkler and edging apparatus 10 is positioned in a predug trench so that the front side 12 faces the target plants 36 which are to be watered. The web portion 22 is placed in the trench, and the trench is filled in, covering the retaining flange 24. At the first end 16, the nipple 54" is secured to the tubular portion 20 by the clamp 44, and a garden hose 28 is connected to the nipple. If additional sections 11 are required, they are connected to each other using the nipple 54' and additional clamps 44. The second end 18 opposite the first end 16 is provided with a nipple 54 to which is connected the plug cap 62. It will be evident that other combinations of hose end connectors and nipples may be used to connect the hose 28 to the tubular portion 20 as is known in the art. Once water is introduced into the passage 26, a spray is emitted through the slits 30, creating a mist which is beneficial to the target plants 36.

While a particular embodiment of the sprinkler and edging apparatus of the invention has been shown and described, it will be appreciated by those skilled in the art that changes and modifications may be made thereto without departing from the invention in its broader aspects and as set forth in the following claims.

What is claimed is:

1. A sprinkler and edging apparatus for use in landscaping, comprising:

at least one section of extruded plastic having a first end, a second end, an upper tubular portion and a vertically depending web portion having at least one retaining flange;

each said tubular portion having a front side and a rear side and being configured to define a passage through which water may be passed;

a plurality of apertures being provided in said front side, such that when water is passed through said passage, each of said apertures emits water under pressure to form a mist for watering target landscape plants; and connecting means at at least one of said ends of said at least one section for connecting said section to a similarly constructed adjacent section, said connecting means including accommodating means in an end portion of the web portion for accommodating clamp means, and means for coupling said sections together.

2. The apparatus as defined in claim 1 further including a plurality of said sections, and said means for connecting adjacent sections together being arranged so that said tubular portions of respective sections are in registry with each other, and such that adjacent sections abut each other in a substantially flush relationship along said tubular portion as well as said web portion.

3. The apparatus as defined in claim 2 wherein said accommodating means includes a notch cut into said first and second ends of each of said sections in said web portion.

4. The apparatus as defined in claim 3 wherein said coupling means includes a tubular nipple and at least one clamp.

5. The apparatus as defined in claim 4 wherein said at least one clamp engages said section at said notch.

6. The apparatus as defined in claim 1 including means for connecting a water supply hose to said at least one section.

7. The apparatus as defined in claim 6 wherein said means for connecting the water supply hose includes a tubular nipple configured to engage one of said ends of said section, and a clamp.

8. The apparatus as defined in claim 7 wherein said tubular nipple has a threaded end for connection to the water supply hose, and a barbed end for insertion into said tubular portion at one of said first and second ends.

9. The apparatus as defined in claim 8 wherein said clamp is provided in two halves split along a horizontal plane, and includes means for fastening said halves together around said tubular end into which said barbed end has been inserted.

10. The apparatus as defined in claim 1 wherein said apertures are arranged on said front side of said tubular portion in at least two spaced, parallel rows.

11. The apparatus as defined in claim 10 wherein said apertures in a first of said rows are positioned to be between said apertures of an adjacent said row, resulting in a staggered appearance of said apertures.

12. The apparatus as defined in claim 1 further including means for plugging one said ends of said at least one section at said tubular portion to prevent the escape of water therefrom.

13. The apparatus as defined in claim 12 wherein said means for plugging includes a clamp, a nipple having barbed and threaded ends, and a threaded cap.

14. The apparatus as defined in claim 13 wherein said web portion includes a notch cut into at least one of said ends, said barbed end of said nipple being insertable into said tubular portion, said clamp including upper and lower halves being joined around said tubular portion at said notch, with said lower half being accommodated in said notch, means for fastening said clamp halves together around said tubular portion at said end into which said nipple has been inserted, and said threaded cap being threadably engaged on said threaded end of said nipple to plug said end of said section.

15. A sprinkler and edging apparatus for use in landscaping, comprising:

at least one section of extruded plastic having a first end, a second end, an upper tubular portion and a vertically depending web portion, said web portion having at least one retaining flange along a lower edge thereof;

each of said first and second ends having a notch cut into said web portion for accommodating means for clamping said end;

each of said tubular portions having a front side and a rear side and being configured to define a passage through which water may be passed;

a plurality of slits being provided in said front side, such that when water is passed through said passage, each of said slits emits water under pressure to form a mist for watering landscape plants.

16. The apparatus as defined in claim 15 wherein said at least one flange is upturned to facilitate the retention of said at least one section in the soil.

17. The apparatus as defined in claim 15 wherein said slits are arranged on said front side of said tubular portion in at least spaced, parallel rows.

18. The apparatus as defined in claim 17 wherein said slits in a first of said rows are positioned to be between said slits of an adjacent row, resulting in a staggered appearance of said slits.

19. The apparatus as defined in claim 15 further including means for plugging one of said ends, and means for coupling an opposite one of said ends to a water supply hose, said means for plugging and said means for coupling both including a clamp configured to engage a corresponding one of said notches.

20. The apparatus as defined in claim 19 further including means for coupling adjacent sections together, said means for coupling including at least one clamp adapted to engage a corresponding end of said section at said notch so that adjacent sections may be joined in a substantially flush abutting relationship.

21. A sprinkler and edging apparatus for use in landscaping, comprising:

at least one section of extruded plastic having a first end, a second end, an upper tubular portion and a vertically depending web portion, said web portion having at least one retaining flange along a lower edge thereof;

each of said first and second ends having accommodating means cut into said web portion for accommodating means for clamping;

each of said tubular portions having a front side and a rear side and being configured to define a passage through which water may be passed;

a plurality of apertures being provided in said front side, such that when water is passed through said passage, each of said apertures emits water under pressure for watering landscape plants.

22. The apparatus as defined in claim 21 wherein said accommodating means includes a notch formed in at least one end of said web portion.

23. The apparatus as defined in claim 21 wherein said apertures are slits configured to emit water under pressure to form a mist.

* * * * *

UNITED STATES PATENT AND TRADEMARK OFFICE

CERTIFICATE OF CORRECTION

PATENT NO. : 5,232,159

DATED : Aug. 3, 1993

INVENTOR(S) : Abbate, Sr. et al.

It is certified that error appears in the above-identified patent and that said Letters Patent is hereby corrected as shown below:

Column 4, line 47, "vertically depending web portion" should be --vertically depending web portion, said web portion--.

Column 5, line 37, "means for plugging one said" should be --means for plugging one of said--.

Column 6, line 18, "at least spaced, parallel rows" should be --at least two spaced, parallel rows--.

Signed and Sealed this

Ninth Day of August, 1994

*Attest:*

*Attesting Officer*

BRUCE LEHMAN

*Commissioner of Patents and Trademarks*